US011286944B2

(12) United States Patent
Fukuyama et al.

(10) Patent No.: US 11,286,944 B2
(45) Date of Patent: Mar. 29, 2022

(54) CENTRIFUGAL COMPRESSOR AND METHOD FOR MANUFACTURING CENTRIFUGAL COMPRESSOR

(71) Applicant: KABUSHIKI KAISHA TOYOTA JIDOSHOKKI, Aichi-ken (JP)

(72) Inventors: Ryosuke Fukuyama, Kariya (JP); Takahito Kunieda, Kariya (JP); Satoru Mitsuda, Kariya (JP); Masahiro Suzuki, Kariya (JP); Ryo Umeyama, Kariya (JP); Yoshiyuki Nakane, Kariya (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 528 days.

(21) Appl. No.: 16/287,294

(22) Filed: Feb. 27, 2019

(65) Prior Publication Data

US 2019/0277301 A1 Sep. 12, 2019

(30) Foreign Application Priority Data

Mar. 9, 2018 (JP) ..... JP2018-043245

(51) Int. Cl.
*F04D 29/063* (2006.01)
*F04D 25/02* (2006.01)
(Continued)

(52) U.S. Cl.
CPC ..... *F04D 29/063* (2013.01); *F04D 25/02* (2013.01); *F04D 29/284* (2013.01);
(Continued)

(58) Field of Classification Search
CPC ..... F04D 29/063; F01D 25/18; F01D 25/183; F01D 25/20; F05D 2260/98
See application file for complete search history.

(56) References Cited

U.S. PATENT DOCUMENTS 4,558,837 A * 12/1985 Mens ..... B64C 25/00 244/104 FP
4,808,083 A * 2/1989 Watanabe ..... F04C 28/14 417/295

(Continued)

FOREIGN PATENT DOCUMENTS

| | | |
|---|---|---|
| CN | 202251051 | 5/2012 |
| JP | 2003-193975 | 7/2003 |
| JP | 2016-186238 | 10/2016 |

*Primary Examiner* — Woody A Lee, Jr.
*Assistant Examiner* — Behnoush Haghighian
(74) *Attorney, Agent, or Firm* — Greenblum & Bernstein, P.L.C.

(57) ABSTRACT

An oil passage of a centrifugal compressor includes a first oil passage that communicates with an oil pan and a speed increaser chamber to supply oil to a speed increaser and the seal. A second oil passage communicates with the speed increaser chamber. A third oil passage extends upward in a gravitational direction from an end of the second oil passage. A fourth oil passage extends in a horizontal direction and causes the oil pan and an end of the third oil passage to communicate with each other. A pressure relief passage that communicates with an outside is arranged in at least one of a portion of the fourth oil passage through which a gas layer passes and a portion of the oil pan in which the gas layer is stored.

6 Claims, 4 Drawing Sheets

(51) Int. Cl.

| | |
|---|---|
| ***F04D 29/28*** | (2006.01) |
| *F04D 17/10* | (2006.01) |
| *F01D 25/18* | (2006.01) |
| *F01D 25/20* | (2006.01) |

(52) U.S. Cl.
CPC ..... *F01D 25/183* (2013.01); *F01D 25/20* (2013.01); *F04D 17/10* (2013.01)

(56) References Cited

U.S. PATENT DOCUMENTS 5,610,341 A * 3/1997 Tortora ..... F01D 17/02 73/756
6,415,704 B1 * 7/2002 Wang ..... F04B 9/127 417/401
7,544,047 B2 * 6/2009 Nakane ..... F04C 29/04 417/372
8,162,636 B2 * 4/2012 Yokoi ..... F04C 29/02 418/55.6
9,765,791 B2 * 9/2017 Kagami ..... F04D 25/045
9,863,476 B2 * 1/2018 Gray ..... H02K 9/06
9,982,687 B2 * 5/2018 Mitsuda ..... F04D 25/0606
10,415,599 B2 * 9/2019 Sun ..... F02C 6/12
10,626,754 B2 * 4/2020 Hashimoto ..... F01C 1/00
10,710,745 B2 * 7/2020 Anderson ..... B64F 1/364
10,746,191 B2 * 8/2020 Fukuyama ..... F04D 29/059
10,760,584 B2 * 9/2020 Fukuyama ..... F04D 29/284
10,767,655 B2 * 9/2020 Fukuyama ..... F04D 25/028
10,851,684 B2 * 12/2020 Feng ..... F01M 1/02
10,859,089 B2 * 12/2020 Snyder ..... F16N 39/06
10,989,215 B2 * 4/2021 Zhang ..... F04D 29/102
11,092,159 B2 * 8/2021 Pawellek ..... F04D 29/043
2002/0083704 A1 * 7/2002 Wang ..... F15B 11/15 60/370
2016/0281740 A1 * 9/2016 Mitsuda ..... F04D 17/10
2017/0159660 A1 * 6/2017 Hashimoto ..... F25B 11/02
2018/0283388 A1 * 10/2018 Fukuyama ..... F04D 25/028
2019/0277301 A1 * 9/2019 Fukuyama ..... F04D 25/028
2020/0102964 A1 * 4/2020 Nakane ..... F04D 27/009
2020/0208644 A1 * 7/2020 Kunieda ..... F04D 29/063
2020/0291832 A1 * 9/2020 Feng ..... F01M 1/02
2021/0071679 A1 * 3/2021 Pawellek ..... F04D 13/06

* cited by examiner

CENTRIFUGAL COMPRESSOR AND METHOD FOR MANUFACTURING CENTRIFUGAL COMPRESSOR

BACKGROUND

1. Field

The following description relates to a centrifugal compressor and a method for manufacturing a centrifugal compressor.

2. Description of Related Art

A typical centrifugal compressor includes a low-speed shaft, an impeller that rotates integrally with a high-speed shaft to compress gas, and a speed increaser that transmits the power of the low-speed shaft to the high-speed shaft. The centrifugal compressor includes a housing. The housing includes an impeller chamber that accommodates the impeller and a speed increaser chamber that accommodates the speed increaser. The impeller chamber and the speed increaser chamber are partitioned by a partition wall. The partition wall has a shaft insertion hole. The high-speed shaft protrudes from the speed increaser chamber into the impeller chamber through the shaft insertion hole.

Japanese Laid-Open Patent Publication No. 2016-186238 describes an example of such a centrifugal compressor. In this centrifugal compressor, oil is supplied to the speed increaser in order to limit the friction and seizure of a part where the high-speed shaft slides on the speed increaser. The oil supplied to the speed increaser is stored in the speed increaser chamber. Thus, a seal is typically provided between the outer circumferential surface of the high-speed shaft and the inner circumferential surface of the shaft insertion hole to restrict the oil stored in the speed increaser chamber from leaking into the impeller chamber through the shaft insertion hole. In this case, the friction and seizure of a part where the high-speed shaft slides on the seal need to be limited. Thus, the seal is supplied with oil.

However, in some cases, when rotation of the impeller compresses gas to increase the pressure in the impeller chamber, the gas leaks from the impeller chamber to the speed increaser chamber through the part between the outer circumferential surface of the high-speed increaser and the inner circumferential surface of the shaft insertion hole, increasing the pressure in the speed increaser chamber. When the pressure in the impeller chamber is lower than the pressure in the speed increaser chamber, for example, when the impeller is rotating at a low speed or when the centrifugal compressor is not running, the oil in the speed increaser chamber may leak into the impeller chamber through the part between the outer circumferential surface of the high-speed shaft and the inner circumferential surface of the shaft insertion hole.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

It is an object of the present disclosure to provide a centrifugal compressor and a method for manufacturing a centrifugal compressor capable of limiting increases in the pressure in a speed increaser chamber while limiting decreases in the amount of oil supplied to a speed increaser and a seal.

Examples of the present disclosure will now be described.

Example 1: A centrifugal compressor includes a low-speed shaft, an impeller that rotates integrally with a high-speed shaft to compress gas, a speed increaser that transmits power of the low-speed shaft to the high-speed shaft, a housing including an impeller chamber that accommodates the impeller and a speed increaser chamber that accommodates the speed increaser, a partition wall that partitions an interior of the housing into the impeller chamber and the speed increaser chamber, the partition wall having a shaft insertion hole through which the high-speed shaft is inserted, a seal provided between an outer circumferential surface of the high-speed shaft and an inner circumferential surface of the shaft insertion hole, an oil pan in which oil supplied to the speed increaser and the seal is stored, and an oil passage through which the oil stored in the oil pan is supplied to the speed increaser and the seal and then returned to the oil pan. The oil passage includes a first oil passage that communicates with the oil pan and the speed increaser chamber to supply oil to the speed increaser and the seal, a second oil passage that communicates with the speed increaser chamber, oil stored in the speed increaser chamber flowing into the second oil passage, a third oil passage extending upward in a gravitational direction from an end of the second oil passage located at a side opposite of the speed increaser chamber, and a fourth oil passage that extends in a horizontal direction and causes the oil pan and an end of the third oil passage located at a side opposite of the second oil passage to communicate with each other. When the oil passes through the third oil passage, fluid including the oil is separated into a gas layer and an oil layer. A pressure relief passage that communicates with the outside is arranged in at least one of a portion of the fourth oil passage through which the gas layer passes and a portion of the oil pan in which the gas layer is stored.

Even if the pressure in the speed increaser chamber increases, the above-described structure allows the pressure to be relieved from the pressure relief passage. This limits increases in the pressure in the speed increaser chamber. Air is mixed with oil that flows from the speed increaser chamber into the second oil passage. The third oil passage extends upward in the gravitational direction, and the fourth oil passage extends in the horizontal direction. When oil passes through the third oil passage, fluid including the oil is separated into the gas layer and the oil layer. The difference in specific gravity between the oil and the air causes the oil layer to pass through the fourth oil passage on the lower side in the gravitational direction and the gas layer to pass through the fourth oil passage on the upper side in the gravitational direction. Since the air and the oil that have been separated respectively into the gas layer and the oil layer in the fourth oil passage flow into the oil pan, the gas layer is stored in the oil pan on the upper side in the gravitational direction and the oil layer is stored in the oil pan on the lower side in the gravitational direction. The pressure relief passage is located in at least one of the portion of the fourth oil passage through which the gas layer passes and the portion of the oil pan in which the gas layer is stored. Thus, the air forming the gas layer is emitted from the pressure relief passage to the outside. This restricts the oil from being emitted to the outside together with the air. Thus, increases in the pressure in the speed increaser chamber are limited while limiting decreases in the amount of oil supplied to the speed increaser and the seal.

For example, a pressure relief valve that opens when the pressure in the speed increaser chamber reaches a predetermined pressure and limits increases in the pressure in the speed increaser chamber by emitting gas in the speed increaser chamber to the outside may be provided. However, in this case, oil may also be emitted to the outside together with gas, reducing the amount of oil supplied to the speed increaser chamber and the seal. The above-described structure reduces such a problem.

Example 2: In the centrifugal compressor according to example 1, the pressure relief passage may be located at the portion of the oil pan in which the gas layer is stored.

The oil pan has a relatively large space. This facilitates separation in the oil pan into the gas layer and the oil layer. Thus, the air forming the gas layer can be easily emitted from the pressure relief passage to the outside.

Example 3: In the centrifugal compressor according to example 1 or 2, the pressure relief passage may include a ventilation film configured to prevent passage of liquid while permitting passage of gas. Thus, the ventilation film restricts foreign matter or moisture from entering the centrifugal compressor from the outside through the pressure relief passage.

Example 4: The centrifugal compressor according to any one of examples 1 to 3 may further include an oil cooler that cools oil flowing through the oil passage. The oil cooler may include a cooling pipe that forms part of the oil passage, and the cooling pipe may form at least part of each of the second oil passage, the third oil passage, and the fourth oil passage.

Thus, the cooling pipe of the oil cooler can be used to form at least part of each of the second oil passage, the third oil passage, and the fourth oil passage. Accordingly, there is no need for an additional structure that forms the second oil passage, the third oil passage, and the fourth oil passage. This simplifies the structure of the centrifugal compressor.

Example 5: A method for manufacturing a centrifugal compressor is provided. The method includes forming an impeller chamber and a speed increaser chamber in a housing of the centrifugal compressor, partitioning, by a partition wall, an interior of the housing into the impeller chamber and the speed increaser chamber, inserting a high-speed shaft through a shaft insertion hole formed in the partition wall, accommodating, in the impeller chamber, an impeller that rotates integrally with the high-speed shaft to compress gas, accommodating, in the speed increaser, a speed increaser that transmits power of the low-speed shaft to the high-speed shaft, providing a seal between an outer circumferential surface of the high-speed shaft and an inner circumferential surface of the shaft insertion hole, providing an oil pan in which oil supplied to the speed increaser and the seal is stored, and providing an oil passage through which the oil stored in the oil pan is supplied to the speed increaser and the seal and then returned to the oil pan. The providing of the oil passage includes causing, by a first oil passage, the oil pan and the speed increaser chamber to communicate with each other to supply oil to the speed increaser and the seal, causing a second oil passage to communicate with the speed increaser chamber so that oil stored in the speed increaser chamber flows into the second oil passage, upwardly extending a third oil passage in a gravitational direction from an end of the second oil passage located at a side opposite of the speed increaser chamber. When the oil passes through the third oil passage, fluid including the oil is separated into a gas layer and an oil layer. The providing of the oil passage further includes causing, by a fourth oil passage that extends in a horizontal direction, the oil pan to communicate with an end of the third oil passage located at a side opposite of the second oil passage, and arranging a pressure relief passage that communicates with the outside in at least one of a portion of the fourth oil passage through which the gas layer passes and a portion of the oil pan in which the gas layer is stored.

Embodiments described in the present disclosure limit increases in the pressure in a speed increaser chamber while limiting decreases in the amount of oil supplied to a speed increaser and a seal.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

A centrifugal compressor according to an embodiment will now be described with reference to FIGS. 1 to 3. The centrifugal compressor of the present embodiment is installed in a fuel cell vehicle (FCV), which travels using a fuel cell as a power source, and supplies air to the fuel cell.

Figure 1:
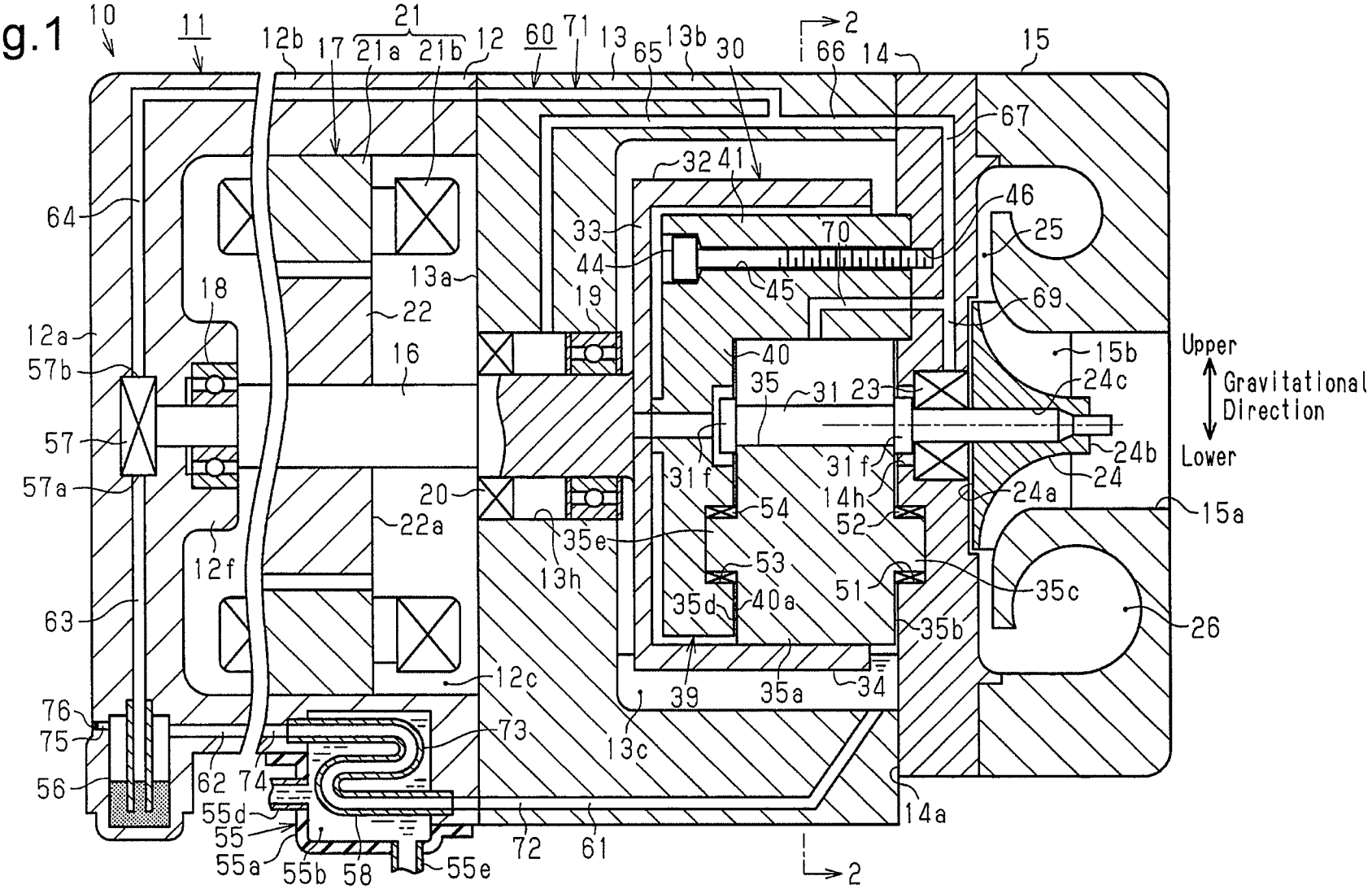
FIG. 1 is a side cross-sectional view showing a centrifugal compressor according to an embodiment.

As shown in FIG. 1, a centrifugal compressor 10 includes a housing 11. The housing 11 includes a motor housing 12, a speed increaser housing 13 coupled to the motor housing 12, a plate 14 coupled to the speed increaser housing 13, and a compressor housing 15 coupled to the plate 14. The motor housing 12, the speed increaser housing 13, the plate 14, and the compressor housing 15 may be made of metal such as aluminum. The housing 11 is substantially tubular. The motor housing 12, the speed increaser housing 13, the plate 14, and the compressor housing 15 are arranged in this order in the axial direction of the housing 11.

The motor housing 12 includes a circular bottom wall 12*a* and a tubular circumferential wall 12*b* extending from the outer edge of the bottom wall 12*a*. The motor housing 12 is tubular and has a closed end. The speed increaser housing 13 includes a circular bottom wall 13*a* and a tubular circumferential wall 13*b* extending from the outer edge of the bottom wall 13*a*. The speed increaser housing 13 is tubular and has a closed end.

The end of the circumferential wall 12*b* of the motor housing 12 located on the side opposite of the bottom wall 12*a* is coupled to the bottom wall 13*a* of the speed increaser housing 13. The opening of the circumferential wall 12*b* of the motor housing 12 located on the side opposite of the bottom wall 12*a* is closed by the bottom wall 13*a* of the speed increaser housing 13. The central portion of the bottom wall 13*a* has a through-hole 13*h*.

The end of the circumferential wall 13*b* of the speed increaser housing 13 located on the side opposite of the bottom wall 13*a* is coupled to the plate 14. The opening of the circumferential wall 13*b* of the speed increaser housing 13 located on the side opposite of the bottom wall 13*a* is closed by the plate 14. The central portion of the plate 14 has an shaft insertion hole 14*h*.

The compressor housing 15 is coupled to the surface of the plate 14 located on the side opposite of the speed increaser housing 13. The compressor housing 15 includes a suction port 15*a* into which air, which is a gas, is drawn. The suction port 15*a* opens in the central portion of the end surface of the compressor housing 15 located on the side opposite of the plate 14 and extends in the axial direction of the housing 11 from the central portion of the end surface of the compressor housing 15 located on the side opposite of the plate 14.

The centrifugal compressor 10 includes a low-speed shaft 16 and an electric motor 17 that rotates the low-speed shaft 16. The housing 11 includes a motor chamber 12*c* that accommodates the electric motor 17. The motor chamber 12*c* is defined by the inner surface of the bottom wall 12*a* of the motor housing 12, the inner circumferential surface of the circumferential wall 12*b*, and the outer surface of the bottom wall 13*a* of the speed increaser housing 13. The low-speed shaft 16 is accommodated in the motor housing 12 with the axial direction of the low-speed shaft 16 coinciding with the axial direction of the motor housing 12. The low-speed shaft 16 may be formed from a metal material made of, for example, iron or alloy.

The motor housing 12 has a tubular boss 12*f* protruding from the inner surface of the bottom wall 12*a*. A first end of the low-speed shaft 16 is inserted into the boss 12*f*. A first bearing 18 is provided between the first end of the low-speed shaft 16 and the boss 12*f*. The first end of the low-speed shaft 16 is rotationally supported by the bottom wall 12*a* of the motor housing 12 with the first bearing 18.

A second end of the low-speed shaft 16 is inserted into the through-hole 13*h*. A second bearing 19 is provided between the second end of the low-speed shaft 16 and the through-hole 13*h*. The second end of the low-speed shaft 16 is rotationally supported by the bottom wall 13*a* of the speed increaser housing 13 with the second bearing 19. Thus, the low-speed shaft 16 is rotationally supported by the housing 11. The second end of the low-speed shaft 16 protrudes from the motor chamber 12*c* into the speed increaser housing 13 through the through-hole 13*h*.

A seal 20 is provided between the second end of the low-speed shaft 16 and the through-hole 13*h*. The seal 20 is located closer to the motor chamber 12*c* than to the second bearing 19 between the second end of the low-speed shaft 16 and the through-hole 13*h*. The seal 20 seals a part between the outer circumferential surface of the low-speed shaft 16 and the inner circumferential surface of the through-hole 13*h*.

The electric motor 17 includes a tubular stator 21 and a rotor 22 arranged in the stator 21. The rotor 22 is fixed to the low-speed shaft 16 and rotates integrally with the low-speed shaft 16. The stator 21 surrounds the rotor 22. The rotor 22 includes a tubular rotor core 22*a* fixed to the low-speed shaft 16 and permanent magnets (not shown) embedded in the rotor core 22*a*. The stator 21 includes a tubular stator core 21*a* fixed on the inner circumferential surface of the circumferential wall 12*b* of the motor housing 12 and a coil 21*b* around which the stator core 21*a* is wound. When current flows into the coil 21*b*, the rotor 22 rotates integrally with the low-speed shaft 16.

The centrifugal compressor 10 includes a high-speed shaft 31 and a speed increaser 30 that transmits the power of the low-speed shaft 16 to the high-speed shaft 31. The housing 11 includes a speed increaser chamber 13*c* that accommodates the speed increaser 30. The speed increaser chamber 13*c* is defined by the inner surface of the bottom wall 13*a*, the inner circumferential surface of the circumferential wall 13*b*, and the plate 14. The speed increaser chamber 13*c* stores oil. The seal 20 restricts the oil stored in the speed increaser chamber 13*c* from leaking into the motor chamber 12*c* through the part between the outer circumferential surface of the low-speed shaft 16 and the inner circumferential surface of the through-hole 13*h*.

The high-speed shaft 31 may be made of a metal such as iron or an alloy. The high-speed shaft 31 is accommodated in the speed increaser chamber 13*c* with the axial direction of the high-speed shaft 31 coinciding with the axial direction of the speed increaser housing 13. The end of the high-speed shaft 31 located on the side opposite of the motor housing 12 protrudes into the compressor housing 15 through the shaft insertion hole 14*h* of the plate 14. The axis of the high-speed shaft 31 coincides with the axis of the low-speed shaft 16.

The centrifugal compressor 10 includes an impeller 24 coupled to the high-speed shaft 31. The housing 11 includes an impeller chamber 15*b* that accommodates the impeller 24. The impeller chamber 15*b* is defined by the compressor housing 15 and the plate 14. The plate 14 is a partition wall that partitions the interior of the housing 11 into the impeller chamber 15*b* and the speed increaser chamber 13*c*. The plate 14, which is a partition wall, includes the shaft insertion hole 14*h*, through which the high-speed shaft 31 is inserted.

A seal 23 is provided between the outer circumferential surface of the high-speed shaft 31 and the inner circumferential surface of the shaft insertion hole 14*h*. The seal 23 is, for example, a mechanical seal. The seal 23 seals a part between the outer circumferential surface of the high-speed shaft 31 and the inner circumferential surface of the shaft insertion hole 14*h*. The seal 23 restricts the oil stored in the speed increaser chamber 13*c* from leaking into the impeller chamber 15*b* through the part between the outer circumferential surface of the high-speed shaft 31 and the inner circumferential surface of the shaft insertion hole 14*h*.

The impeller chamber 15*b* and the suction port 15*a* communicate with each other. The impeller chamber 15*b* has the form of a substantially truncated cone hole of which the diameter gradually increases as the suction port 15*a* becomes farther away. A protruding end of the high-speed shaft 31 that protrudes into the compressor housing 15 protrudes toward the impeller chamber 15*b*.

The impeller 24 is tubular and gradually decreases in diameter from a basal surface 24*a* toward a distal surface

24*b*. The impeller 24 has an insertion hole 24*c* that extends in the rotation axial direction of the impeller 24. The high-speed shaft 31 can be inserted through the insertion hole 24*c*. The impeller 24 is coupled to the high-speed shaft 31 so as to rotate integrally with the high-speed shaft 31 in a state in which the protruding end of the high-speed shaft 31 protruding into the compressor housing 15 is inserted through the insertion hole 24*c*. Thus, rotation of the high-speed shaft 31 rotates the impeller 24, thereby compressing air drawn in from the suction port 15*a*. Accordingly, the impeller 24 rotates integrally with the high-speed shaft 31 to compress air.

Further, the centrifugal compressor 10 includes a diffuser passage 25 into which air compressed by the impeller 24 flows and a discharge chamber 26 into which air that has passed through the diffuser passage 25 flows.

The diffuser passage 25 is defined by the surface of the compressor housing 15 opposed to the plate 14 and by the plate 14. The diffuser passage 25 is located outside the impeller chamber 15*b* in the radial direction of the high-speed shaft 31 and communicates with the impeller chamber 15*b*. The diffuser passage 25 has an annular shape surrounding the impeller 24 and impeller chamber 15*b*.

The discharge chamber 26 is located outside the diffuser passage 25 in the radial direction of the high-speed shaft 31 and communicates with the diffuser passage 25. The discharge chamber 26 is annular. The impeller chamber 15*b* and the discharge chamber 26 communicate with each other through the diffuser passage 25. When air compressed by the impeller 24 passes through the diffuser passage 25, the air is further compressed. Then, the air flows into the discharge chamber 26 and is discharged out of the discharge chamber 26.

The speed increaser 30 increases the speed of rotation of the low-speed shaft 16 and transmits the rotation to the high-speed shaft 31. The speed increaser 30 is of a traction drive type (friction roller type). The speed increaser 30 includes a ring 32 coupled to the second end of the low-speed shaft 16. The ring 32 may be made of metal. The ring 32 rotates as the low-speed shaft 16 rotates. The ring 32 includes a circular base 33 coupled to the second end of the low-speed shaft 16 and a tube 34 extending from the outer edge of the base 33. The ring 32 is tubular and has a closed end. The base 33 extends in the radial direction of the low-speed shaft 16 toward the low-speed shaft 16. The axis of the tube 34 coincides with the axis of the low-speed shaft 16.

Figure 2:
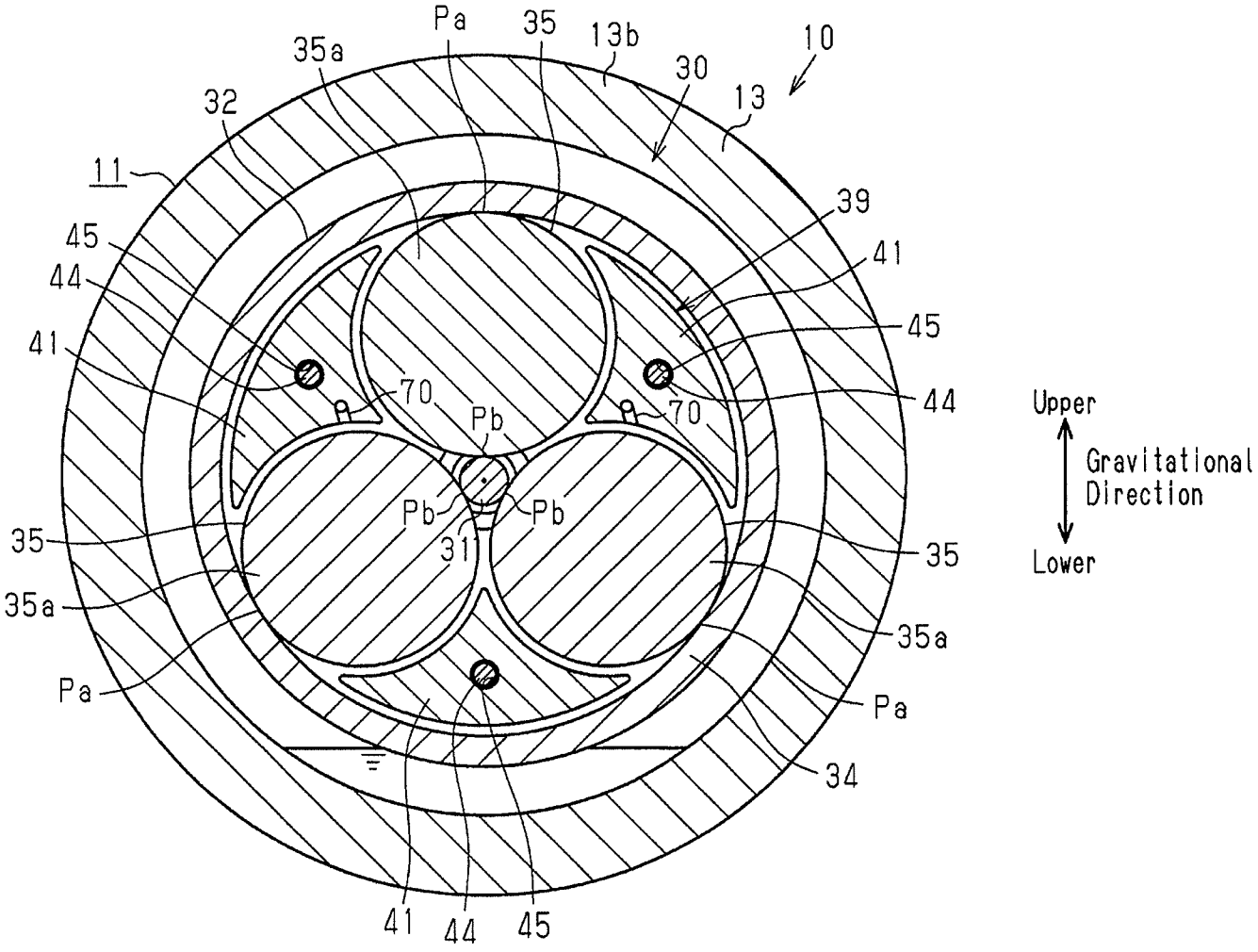
FIG. 2 is a cross-sectional view taken along line 2-2 in FIG. 1.

As shown in FIG. 2, the high-speed shaft 31 is partially located in the tube 34. Further, the speed increaser 30 includes three rollers 35 arranged between the tube 34 and the high-speed shaft 31. The three rollers 35 are made of, for example, metal. The three rollers 35 may be made of the same metal as the high-speed shaft 31 such as iron or iron alloy. The three rollers 35 are spaced apart from one another in the circumferential direction of the high-speed shaft 31 by a set interval (for example, 120 degrees). The three rollers 35 have the same shape. The three rollers 35 are in contact with both the inner circumferential surface of the tube 34 and the outer circumferential surface of the high-speed shaft 31.

As shown in FIG. 1, each roller 35 includes a columnar roller part 35*a*, a columnar first protuberance 35*c* protruding from a first end surface 35*b* in the axial direction of the roller part 35*a*, and a columnar second protuberance 35*e* protruding from a second end surface 35*d* in the axial direction of the roller part 35*a*. The axis of the roller part 35*a*, the axis of the first protuberance 35*c*, and the axis of the second protuberance 35*e* coincide with one another. The direction in which the axis of the roller part 35*a* of each roller 35 extends (rotation axial direction) coincides with the axial direction of the high-speed shaft 31. The roller part 35*a* has a larger outer diameter than the high-speed shaft 31.

As shown in FIGS. 1 and 2, the speed increaser 30 includes a support 39 that rotationally supports each roller 35 in cooperation with the plate 14. The support 39 is located in the tube 34. The support 39 includes a circular support base 40 and three pillar-shaped upright walls 41 projecting from the support base 40. The support base 40 is opposed to the plate 14 in the rotation axial direction of each roller 35. The three upright walls 41 extend toward the plate 14 from a surface 40*a* of the support base 40 located toward the plate 14. The three upright walls 41 are arranged so as to fill the three spaces defined by the inner circumferential surface of the tube 34 and the outer circumferential surfaces of two adjacent ones of the roller parts 35*a*.

The support 39 has three bolt insertion holes 45 through which bolts 44 can be inserted. Each bolt insertion hole 45 extends through the corresponding one of the three upright walls 41 in the rotation axial direction of the roller 35. As shown in FIG. 1, a surface 14*a* of the plate 14 located toward the support 39 has an internal thread hole 46 that communicates with each bolt insertion hole 45. Fastening the bolts 44 inserted through the bolt insertion holes 45 to the internal thread holes 46 couples the support 39 to the plate 14.

The surface 14*a* of the plate 14 located toward the support 39 includes three recesses 51 (only one recess 51 is shown in FIG. 1). The three recesses 51 are spaced apart from one another in the circumferential direction of the high-speed shaft 31 by a set interval (for example, 120 degrees). The three recesses 51 are located in positions corresponding with the three rollers 35. The three recesses 51 each include an annular roller bearing 52.

The surface 40*a* of the support base 40 located toward the plate 14 includes three recesses 53 (only one recess 53 is shown in FIG. 1). The three recesses 53 are spaced apart from one another in the circumferential direction of the high-speed shaft 31 by a set interval (for example, 120 degrees). The three recesses 53 are located in positions corresponding with the three rollers 35. The three recesses 53 each include an annular roller bearing 54.

The first protuberance 35*c* of each roller 35 is inserted into the roller bearing 52 of the corresponding recess 51 and is rotationally supported by the plate 14 with the roller bearing 52. The second protuberance 35*e* of each roller 35 is inserted into the roller bearing 54 of the corresponding recess 53 and is rotationally supported by the support 39 with the roller bearing 54.

The high-speed shaft 31 includes two flanges 31*f* opposed to each other and spaced apart from each other in the axial direction of the high-speed shaft 31. The roller parts 35*a* of the three rollers 35 are held between the two flanges 31*f*. This limits displacement of the high-speed shaft 31 from the roller parts 35*a* of the three rollers 35 in the axial direction of the high-speed shaft 31.

As shown in FIG. 2, the three rollers 35, the ring 32, and the high-speed shaft 31 are unitized with the three rollers 35, the high-speed shaft 31, and the tube 34 pressed toward one another. The high-speed shaft 31 is rotationally supported by the three rollers 35.

The outer circumferential surfaces of the roller parts 35*a* of the three rollers 35 are in contact with the inner circumferential surface of the tube 34 at ring-side contact portions Pa to which a pressing load is applied. Further, the outer circumferential surfaces of the rollers 35 are in contact with the outer circumferential surface of the high-speed shaft 31 at shaft-side contact portions Pb to which a pressing load is applied. The ring-side contact portions Pa and the shaft-side contact portions Pb extend in the axial direction of the high-speed shaft 31.

When the electric motor 17 is driven to rotate the low-speed shaft 16 and the ring 32, the rotation force of the ring 32 is transmitted to the three rollers 35 through the ring-side contact portions Pa so that the three rollers 35 rotate. Then, the rotation force of the three rollers 35 are transmitted to the high-speed shaft 31 through the shaft-side contact portions Pb. As a result, the high-speed shaft 31 rotates. The ring 32 rotates at the same speed as the low-speed shaft 16, and the three rollers 35 rotate at a higher speed than the low-speed shaft 16. The high-speed shaft 31, which has a smaller outer diameter than the three rollers 35, rotates at a higher speed than the three rollers 35. Thus, the speed increaser 30 allows the high-speed shaft 31 to rotate at a higher speed than the low-speed shaft 16.

As shown in FIG. 1, the centrifugal compressor 10 includes an oil passage 60 through which oil is supplied to the speed increaser 30 and the seal 23. Further, the centrifugal compressor 10 includes an oil cooler 55 that cools oil flowing through the oil passage 60, an oil pan 56 in which the oil supplied to the speed increaser 30 and the seal 23 is stored, and an oil pump 57 that pumps and discharges the oil stored in the oil pan 56. The oil passage 60 allows the oil stored in the oil pan 56 to be supplied to the speed increaser 30 and the seal 23.

The oil cooler 55 includes a cover 55*a* coupled to the outer circumferential surface of the circumferential wall 12*b* of the motor housing 12. The cover 55*a* is tubular and has a closed end. The inner surface of the cover 55*a* and the outer circumferential surface of the circumferential wall 12*b* of the motor housing 12 define a space 55*b*. Further, the oil cooler 55 includes a cooling pipe 58 arranged in the space 55*b*. The two ends of the cooling pipe 58 are supported by the motor housing 12. The cooling pipe 58 configures part of the oil passage 60.

Figure 3:
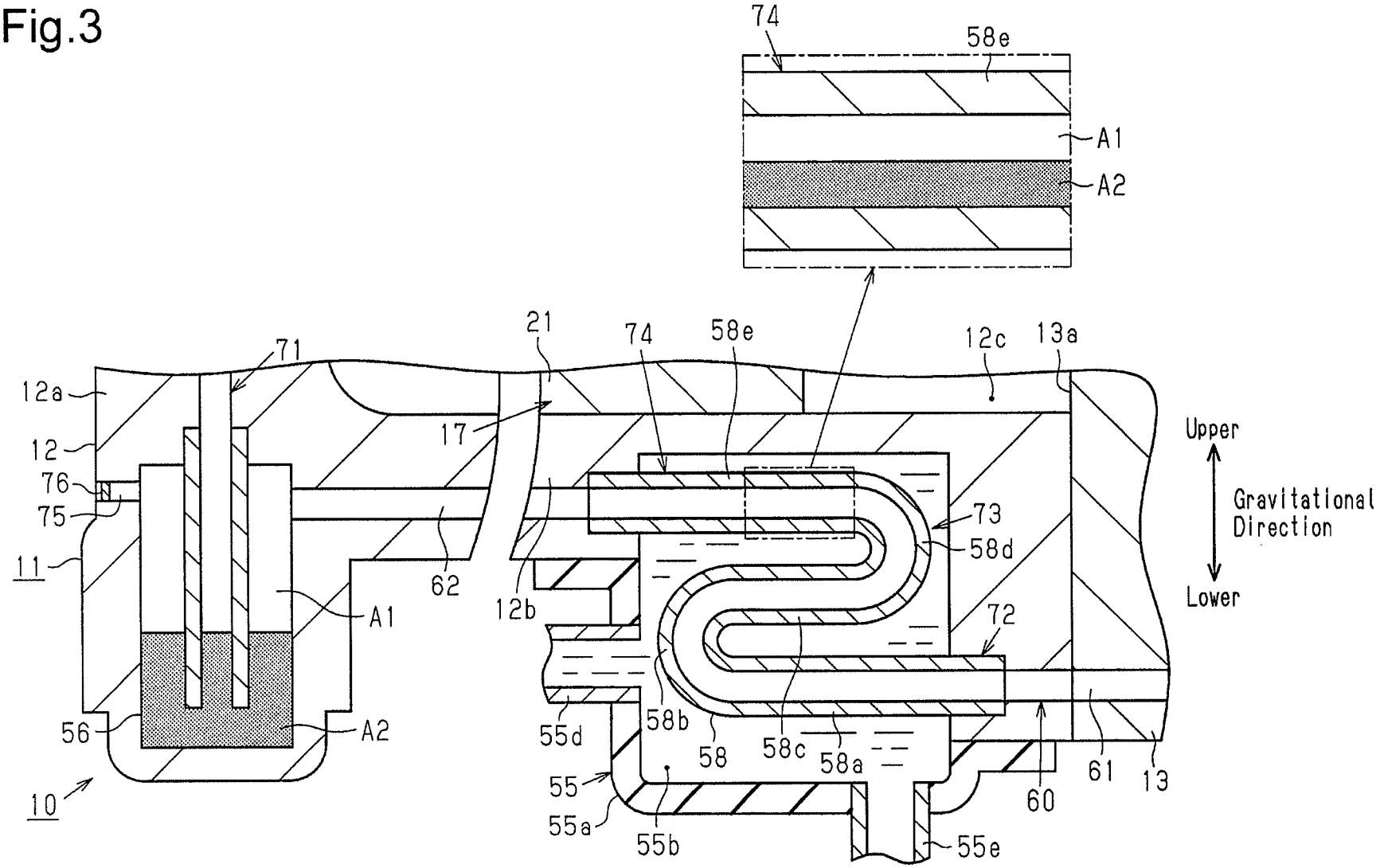
FIG. 3 is an enlarged cross-sectional view showing the vicinity of an oil cooler and an oil pan in the centrifugal compressor of FIG. 1.

As shown in FIG. 3, the cooling pipe 58 includes a first straight part 58*a*, a first curved part 58*b*, a second straight part 58*c*, a second curved part 58*d*, and a third straight part 58*e*. A first end of the first straight part 58*a* forms an inlet of the cooling pipe 58. A second end of the first straight part 58*a* communicates with a first end of the first curved part 58*b*. The first curved part 58*b* is curved in a semicircular manner from the second end of the first straight part 58*a*. The second end of the first curved part 58*b* communicates with a first end of the second straight part 58*c*. A second end of the second straight part 58*c* communicates with a first end of the second curved part 58*d*. The second curved part 58*d* is curved in a semicircular manner from the second end of the second straight part 58*c* to be spaced apart from the first straight part 58*a*. A second end of the second curved part 58*d* communicates with a first end of the third straight part 58*e*. A second end of the third straight part 58*e* forms an outlet of the cooling pipe 58. The first straight part 58*a*, the second straight part 58*c*, and the third straight part 58*e* extend in parallel to one another.

The centrifugal compressor 10 is installed in a fuel cell vehicle so that the first straight part 58*a* is located below the second straight part 58*c* and the third straight part 58*e* in the gravitational direction and the first straight part 58*a*, the second straight part 58*c*, and the third straight part 58*e* extend in parallel. Thus, the inlet of the cooling pipe 58 is located below the outlet of the cooling pipe 58 in the gravitational direction. The first curved part 58*b* is upwardly curved from the second end of the first straight part 58*a* in the gravitational direction. The second curved part 58*d* is upwardly curved from the second end of the second straight part 58*c* in the gravitational direction.

The cover 55*a* includes an intake pipe 55*d* and a discharge pipe 55*e*. A low-temperature fluid is drawn from the intake pipe 55*d* into the space 55*b*. The low-temperature fluid drawn into the space 55*b* is discharged out of the discharge pipe 55*e* and cooled by a cooling device (not shown). Then, the low-temperature fluid is drawn again from the intake pipe 55*d* into the space 55*b*. The low-temperature fluid is, for example, water.

As shown in FIG. 1, the oil pan 56 is formed in the bottom wall 12*a* of the motor housing 12. The oil pan 56 is located on the outer circumferential side of the bottom wall 12*a* of the motor housing 12. Further, the oil pump 57 is located in the bottom wall 12*a* of the motor housing 12. The oil pump 57 is, for example, a trochoid pump. The oil pump 57 is coupled to the first end of the low-speed shaft 16. Rotation of the low-speed shaft 16 drives the oil pump 57.

The oil passage 60 includes a first connection passage 61 that connects the speed increaser chamber 13*c* to the oil cooler 55. The first connection passage 61 extends through the speed increaser housing 13 into the circumferential wall 12*b* of the motor housing 12. A first end of the first connection passage 61 opens in the speed increaser chamber 13*c*. A second end of the first connection passage 61 is connected to the first end of the first straight part 58*a* of the cooling pipe 58.

The centrifugal compressor 10 is installed in a fuel cell vehicle so that the part of the first connection passage 61 opening in the speed increaser chamber 13*c* is located on the lower side in a gravitational direction. Thus, oil in the speed increaser chamber 13*c* flows into the first connection passage 61.

The oil passage 60 includes a second connection passage 62 that connects the oil cooler 55 to the oil pan 56. The second connection passage 62 is formed in the motor housing 12. A first end of the second connection passage 62 is connected to the second end of the third straight part 58*e* of the cooling pipe 58. A second end of the second connection passage 62 opens upward in the oil pan 56 in the gravitational direction. The second connection passage 62 extends in the horizontal direction.

The oil stored in the speed increaser chamber 13*c* flows into the first connection passage 61 and passes through the first connection passage 61, the cooling pipe 58, and the second connection passage 62. The oil passing through the cooling pipe 58 is cooled through heat exchange with a low-temperature fluid drawn into the space 55*b* of the oil cooler 55. The oil cooled by the oil cooler 55 is stored in the oil pan 56.

The oil passage 60 includes a third connection passage 63 that connects the oil pan 56 to the oil pump 57. The third connection passage 63 is formed in the motor housing 12. A first end of the third connection passage 63 protrudes into the oil pan 56. A second end of the third connection passage 63 is connected to a suction port 57*a* of the oil pump 57.

The oil passage 60 includes a fourth connection passage 64 connected to a discharge port 57*b* of the oil pump 57. The fourth connection passage 64 extends through the bottom wall 12*a* and the circumferential wall 12*b* of the motor housing 12 into the circumferential wall 13*b* of the speed increaser housing 13. A first end of the fourth connection passage 64 is connected to the discharge port 57*b* of the oil pump 57. A second end of the fourth connection passage 64 is located in the circumferential wall 13*b* of the speed increaser housing 13.

The oil passage 60 includes a first branch passage 65 and a second branch passage 66 that branch from the second end of the fourth connection passage 64. The first branch passage 65 extends from the second end of the fourth connection passage 64 toward the motor housing 12 through the circumferential wall 13*b* and the bottom wall 13*a* of the speed increaser housing 13. A first end of the first branch passage 65 communicates with the second end of the fourth connection passage 64. A second end of the first branch passage 65 opens in the through-hole 13*h*.

The second branch passage 66 extends from the second end of the fourth connection passage 64 toward the plate 14 and extends through the circumferential wall 13*b* of the speed increaser housing 13 into the plate 14. A first end of the second branch passage 66 communicates with the second end of the fourth connection passage 64. A second end of the second branch passage 66 is located in the plate 14.

The oil passage 60 includes a common passage 67 that communicates with the second end of the second branch passage 66. The common passage 67 extends in a direction orthogonal to the second branch passage 66 and extends straight downward in the gravitational direction from the second end of the second branch passage 66. The oil passage 60 further includes a seal-side supply passage 69 and a speed increaser-side supply passage 70 that branch from the common passage 67. The seal-side supply passage 69 extends straight downward in the gravitational direction from the common passage 67 and opens in the shaft insertion hole 14*h*. The opening of the seal-side supply passage 69 toward the shaft insertion hole 14*h* is opposed to the seal 23. The speed increaser-side supply passage 70 extends straight from the common passage 67 toward the side opposite of the compressor housing 15 through the plate 14. The speed increaser-side supply passage 70 also extends through the upright wall 41 to open at a position of the upright wall 41 facing the outer circumferential surface of the roller part 35*a*. Thus, the speed increaser-side supply passage 70 communicates with the speed increaser chamber 13*c*.

The third connection passage 63, the fourth connection passage 64, the second branch passage 66, the common passage 67, the seal-side supply passage 69, and the speed increaser-side supply passage 70 form a first oil passage 71. The first oil passage 71 communicates with the oil pan 56 and the speed increaser chamber 13*c* and supplies oil to the speed increaser 30 and the seal 23. Thus, the oil passage 60 includes the first oil passage 71, which communicates with the oil pan 56 and the speed increaser chamber 13*c* and supplies oil to the speed increaser 30 and the seal 23.

As shown in FIG. 3, the oil passage 60 includes a second oil passage 72 that communicates with the speed increaser 13*c*. The oil supplied to the speed increaser 30 and the seal 23 and stored in the speed increaser chamber 13*c* flows into the second oil passage 72. The oil passage 72 is configured by the first connection passage 61 and by the first straight part 58*a*, the first curved part 58*b*, and the second straight part 58*c* of the cooling pipe 58.

The oil passage 60 further includes a third oil passage 73 extending upward in the gravitational direction from the end of the second oil passage 72 located on the side opposite of the speed increaser chamber 13*c*. The second end of the second straight part 58*c* is the end of the second oil passage 72 located on the side opposite of the speed increaser chamber 13*c*. In the present embodiment, the second curved part 58*d* extending in a curve from the second end of the second straight part 58*c* configures the third oil passage 73.

The oil passage 60 further includes a fourth oil passage 74 that extends in the horizontal direction and facilitates communication between the oil pan 56 and the end of the third oil passage 73 located on the side opposite of the second oil passage 72. The second end of the second curved part 58*d* is the end of the third oil passage 73 located on the side opposite of the second oil passage 72. In the present embodiment, the second third portion 58*e* and the second connection passage 62 extending in the horizontal direction from the second end of the second curved part 58*d* configure the fourth oil passage 74.

Thus, in the cooling pipe 58, the first straight part 58*a*, the first curved part 58*b*, and the second straight part 58*c* form part of the second oil passage 72, the second curved part 58*d* forms part of the third oil passage 73, and the third straight part 58*e* forms part of the fourth oil passage 74. The oil passage 60, which includes the first oil passage 71, the second oil passage 72, the third oil passage 73, and the fourth oil passage 74, causes the oil stored in the oil pan 56 to be supplied to the speed increaser 30 and the seal 23 and then returned to the oil pan 56.

The upper portion of the oil pan 56 in the gravitational direction includes a pressure relief passage 75 that communicates with the outside. The pressure relief passage 75 includes a ventilation film 76. The ventilation film 76 is a film that prevents passage of liquid while permitting passage of gas.

When the electric motor 17 is driven, the low-speed shaft 16 rotates to drive the oil pump 57. Thus, oil stored in the oil pan 56 is drawn into the oil pump 57 through the third connection passage 63 and the suction port 57*a* and discharged to the fourth connection passage 64 through the discharge port 57*b*. As the rotation speed of the low-speed shaft 16 increases, the oil pump 57 is driven so that the amount of the oil discharged out of the discharge port 57*b* increases proportionally. The oil discharged to the fourth connection passage 64 flows through the fourth connection passage 64 and is distributed to the first branch passage 65 and the second branch passage 66.

The oil distributed from the fourth connection passage 64 to the first branch passage 65 flows through the first branch passage 65 into the through-hole 13*h* and is supplied to the seal 20 and the second bearing 19. This allows for lubrication at the part where the seal 20 slides on the low-speed shaft 16 and the part where the second bearing 19 slides on the low-speed shaft 16.

The oil distributed from the fourth connection passage 64 to the second branch passage 66 flows through the second branch passage 66 into the common passage 67. Some of the oil flowing through the common passage 67 is distributed to the seal-side supply passage 69 and the remaining oil flows through the speed increaser-side supply passage 70. The oil distributed from the common passage 67 to the seal-side supply passage 69 flows through the seal-side supply passage 69 into the shaft insertion hole 14*h* and is supplied to the seal 23. This allows for lubrication at the portion where the seal 23 slides on the high-speed shaft 31. Further, the oil flowing through the speed increaser-side supply passage 70 is supplied to the outer circumferential surface of the roller part 35*a*. This allows for lubrication at the portion where the roller part 35*a* slides on the high-speed shaft 31. The oils that contribute to the lubrication at the part where the seal 23 slides on the high-speed shaft 31 and the part where the roller part 35*a* slides on the high-speed shaft 31 is returned to the speed increaser chamber 13*c*.

The operation of the present embodiment will now be described.

Air is mixed with oil flowing from the speed increaser 13*c* to the second oil passage 72. The third oil passage 73 extends upward in the gravitational direction, and the fourth oil passage 74 extends in the horizontal direction. Thus, when the oil passes through the third oil passage 73, fluid including the oil is separated into an air layer A1, which is a gas layer, and an oil layer A2. As shown in FIG. 3 in an enlarged manner, the difference in specific gravity between the oil and the air causes the oil layer A2 to pass through the fourth oil passage 74 on the lower side in the gravitational direction and the air layer A1 to pass through the fourth oil passage 74 on the upper side in the gravitational direction.

The air and the oil separated into the air layer A1 and the oil layer A2 in the fourth oil passage 74 flow into the oil pan 56. Thus, the air layer A1 is stored in the oil pan 56 on the upper side in the gravitational direction, and the oil layer A2 is stored in the oil pan 56 on the lower side in the gravitational direction.

The pressure relief passage 75 is arranged at the upper portion of the oil pan 56 in the gravitational direction, that is, the portion of the oil pan 56 in which the air layer A1 is stored. Thus, the air forming the air layer A1 is emitted from the pressure relief passage 75 to the outside. This restricts the oil from being emitted to the outside together with the air, thereby limiting increases in the pressure in the speed increaser chamber 13*c*.

The above-described embodiment has the following advantages.

(1) The portion of the oil pan 56 in which the air layer A1 is stored includes the pressure relief passage 75. When rotation of the impeller 24 compresses air, the pressure in the impeller chamber 15*b* increases. This may cause the air to leak from the impeller chamber 15*b* to the speed increaser chamber 13*c* through the part between the outer circumferential surface of the high-speed shaft 31 and the inner circumferential surface of the shaft insertion hole 14*h*. Even if the pressure in the speed increaser chamber 13*c* increases, the air leakage allows the pressure to be relieved from the pressure relief passage 75. This limits increases in the pressure in the speed increaser chamber 13*c*. Further, when oil passes through the third oil passage 73, fluid including the oil is separated into the air layer A1 and the oil layer A2 so that the air layer A1 is stored in the oil pan 56 on the upper side in the gravitational direction and the oil layer A2 is stored in the oil pan 56 on the lower side in the gravitational direction. The pressure relief passage 75 is located at the portion of the oil pan 56 in which the air layer A1 is stored. Thus, the air forming the air layer A1 is emitted from the pressure relief passage 75 to the outside. This restricts the oil from being emitted to the outside together with the air. That is, increases in the pressure in the speed increaser chamber 13*c* are limited while limiting decreases in the amount of oil supplied to the speed increaser 30 and the seal 23.

(2) The pressure relief passage 75 is located at the portion of the oil pan 56 in which the air layer A1 is stored. The oil pan 56 has a relatively large space. This facilitates separation in the oil pan 56 into the air layer A1, which is formed by air on the upper side in the gravitational direction, and the oil layer A2, which is formed by oil on the lower side in the gravitational direction. Thus, the air forming the air layer A1 can be easily emitted from the pressure relief passage 75 to the outside.

(3) The pressure relief passage 75 includes the ventilation film 76, which prevents passage of liquid while permitting passage of gas. Thus, the ventilation film 76 restricts foreign matter or moisture from entering the centrifugal compressor 10 from the outside through the pressure relief passage 75.

(4) The cooling pipe 58 of the oil cooler 55 forms at least part of the second oil passage 72, the third oil passage 73, and the fourth oil passage 74. Thus, the cooling pipe 58 of the oil cooler 55, which is a conventional structure, can be used to form at least part of each of the second oil passage 72, the third oil passage 73, and the fourth oil passage 74. Accordingly, there is no need for an additional structure that forms the second oil passage 72, the third oil passage 73, and the fourth oil passage 74. This simplifies the structure of the centrifugal compressor 10.

(5) Increases in the pressure in the speed increaser chamber 13*c* are limited. Thus, even when the pressure in the impeller chamber 15*b* is lower than the pressure in the speed increaser chamber 13*c*, for example, when the impeller 24 is rotating at a low speed or when the centrifugal compressor 10 is not running, the difference between the pressure in the speed increaser chamber 13*c* and the pressure in the impeller chamber 15*b* can be reduced. This restricts oil in the speed increaser chamber 13*c* from leaking to the impeller chamber 15*b* through the part between the outer circumferential surface of the high-speed shaft 31 and the inner circumferential surface of the shaft insertion hole 14*h*.

(6) The leakage of oil from the speed increaser chamber 13*c* to the impeller chamber 15*b* is restricted. This restricts the oil from being supplied to the fuel cell together with the air compressed by the centrifugal compressor 10 and thus avoids decreases in the power generation efficiency of the fuel cell.

It should be apparent to those skilled in the art that the present disclosure may be embodied in many other specific forms without departing from the spirit or scope of the disclosure. Particularly, it should be understood that the present disclosure may be embodied in the following forms.

Figure 4:
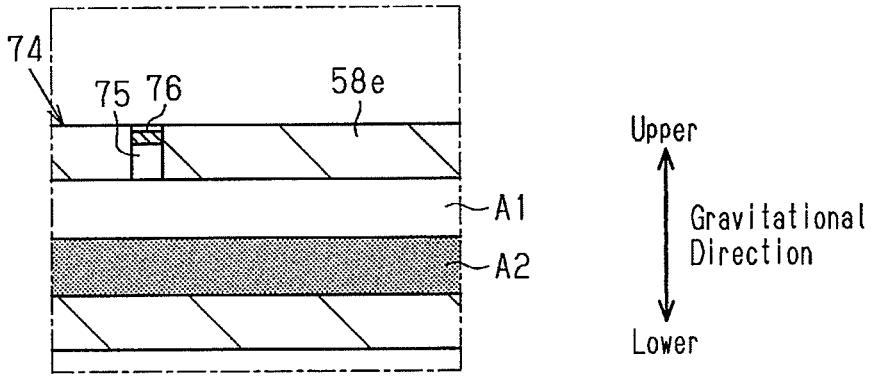
FIG. 4 is a cross-sectional view schematically showing a third supply passage in another embodiment.

As shown in FIG. 4, the pressure relief passage 75, which communicates with the outside, may be arranged at the upper portion of the fourth oil passage 74 in the gravitational direction, that is, a portion of the fourth oil passage 74 through which the air layer A1 passes. Thus, air forming the air layer A1 is emitted from the pressure relief passage 75 to the outside. This restricts oil from being emitted to the outside together with air. Further, in this case, the pressure relief passage 75 may be located at the portion of the oil pan 56 in which the air layer A1 is stored or does not have to be arranged at the portion of the oil pan 56 in which the air layer A1 is stored. In short, the pressure relief passage 75 simply needs to be arranged in at least one of the portion of the fourth oil passage 74 through which the air layer A1 passes and the portion of the oil pan 56 in which the air layer A1 is stored.

In the above-described embodiment, the second oil passage 72, the third oil passage 73, and the fourth oil passage 74 may be formed only by the cooling pipe 58 of the oil cooler 55. In short, the cooling pipe 58 simply forms at least part of the second oil passage 72, the third oil passage 73, and the fourth oil passage 74.

In the above-described embodiment, the cooling pipe 58 of the oil cooler 55 does not have to be used to form part of the second oil passage 72, the third oil passage 73, and the fourth oil passage 74. Instead, for example, the second oil passage 72, the third oil passage 73, and the fourth oil passage 74 may be formed in the housing 11.

In the above-described embodiment, the pressure relief passage 75 may include a pressure relief valve that opens when the pressure in the speed increaser chamber 13*c* reaches a predetermined pressure. The pressure relief valve may be an electromagnetic valve that is opened and closed by an electric signal and opens only when the centrifugal compressor 10 is running.

In the above-described embodiment, the centrifugal compressor 10 may be applied to any device, and the fluid compressed by the centrifugal compressor 10 may be any substance. For example, the centrifugal compressor 10 may be used for an air-conditioner, and the gas subject to compression may be a refrigerant gas. Further, the centrifugal compressor 10 does not have to be installed in a vehicle and may be installed in any machine.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A centrifugal compressor, comprising:

a low-speed shaft;

an impeller that rotates integrally with a high-speed shaft to compress gas;

a speed increaser that transmits power of the low-speed shaft to the high-speed shaft;

a housing including an impeller chamber that accommodates the impeller and a speed increaser chamber that accommodates the speed increaser;

a partition wall that partitions an interior of the housing into the impeller chamber and the speed increaser chamber, wherein the partition wall has a shaft insertion hole through which the high-speed shaft is inserted;

a seal provided between an outer circumferential surface of the high-speed shaft and an inner circumferential surface of the shaft insertion hole;

an oil pan in which oil supplied to the speed increaser and the seal is stored;

an oil passage through which the oil stored in the oil pan is supplied to the speed increaser and the seal and then returned to the oil pan, wherein the oil passage includes:

a first oil passage that communicates with the oil pan and the speed increaser chamber to supply oil to the speed increaser and the seal, a second oil passage that communicates with the speed increaser chamber, wherein oil stored in the speed increaser chamber flows into the second oil passage, a third oil passage extending upward in a gravitational direction from an end of the second oil passage located at a side opposite of the speed increaser chamber, and a fourth oil passage that extends in a horizontal direction and causes the oil pan and an end of the third oil passage located at a side opposite of the second oil passage to communicate with each other, when the oil passes through the third oil passage, fluid including the oil is separated into a gas layer and an oil layer, a pressure relief passage that communicates with an outside is arranged in at least one of a portion of the fourth oil passage through which the gas layer passes and a portion of the oil pan in which the gas layer is stored, and an oil cooler that cools oil flowing through the oil passage, wherein the oil cooler includes a cooling pipe that forms part of the oil passage, and the cooling pipe forms at least part of each of the second oil passage, the third oil passage, and the fourth oil passage, wherein a first end of the cooling pipe is a part of the second oil passage, a second end of the cooling pipe is part of the fourth oil passage, the cooling pipe is configured to extend only upward in the gravitational direction and in the horizontal direction from the first end of the cooling pipe disposed on a speed increaser side of the oil cooler to the second end of the cooling pipe disposed on an oil pan side of the oil cooler, the axis of the high-speed shaft coincides with the axis of the low-speed shaft, and the centrifugal compressor is configured to be mounted on a vehicle so that the oil pan is located on the lower side and downward in the gravitational direction with respect to the axis line of the high-speed side shaft and the axis line of the low-speed shaft.

2. The centrifugal compressor according to claim 1, wherein the pressure relief passage is located at the portion of the oil pan in which the gas layer is stored.

3. The centrifugal compressor according to claim 1, wherein the pressure relief passage includes a ventilation film configured to prevent passage of liquid while permitting passage of gas.

4. A method for manufacturing a centrifugal compressor, the method comprising:

forming an impeller chamber and a speed increaser chamber in a housing of the centrifugal compressor;

partitioning, by a partition wall, an interior of the housing into the impeller chamber and the speed increaser chamber;

inserting a high-speed shaft through a shaft insertion hole formed in the partition wall;

accommodating, in the impeller chamber, an impeller that rotates integrally with the high-speed shaft to compress gas;

accommodating, in the speed increaser, a speed increaser that transmits power of the low-speed shaft to the high-speed shaft;

providing a seal between an outer circumferential surface of the high-speed shaft and an inner circumferential surface of the shaft insertion hole;

providing an oil pan in which oil supplied to the speed increaser and the seal is stored;

providing an oil passage through which the oil stored in the oil pan is supplied to the speed increaser and the seal and then returned to the oil pan, wherein the providing of the oil passage includes:

causing, by a first oil passage, the oil pan and the speed increaser chamber to communicate with each other to supply oil to the speed increaser and the seal, causing a second oil passage to communicate with the speed increaser chamber so that oil stored in the speed increaser chamber flows into the second oil passage, upwardly extending a third oil passage in a gravitational direction from an end of the second oil passage located at a side opposite of the speed increaser chamber, wherein when the oil passes through the third oil passage, fluid including the oil is separated into a gas layer and an oil layer, and causing, by a fourth oil passage that extends in a horizontal direction, the oil pan to communicate with an end of the third oil passage located at a side opposite of the second oil passage, arranging a pressure relief passage that communicates with an outside in at least one of a portion of the fourth oil passage through which the gas layer passes and a portion of the oil pan in which the gas layer is stored, providing an oil cooler that cools oil flowing through the oil passage, wherein the oil cooler includes a cooling pipe that forms part of the oil passage, and the cooling pipe forms at least part of each of the second oil passage, the third oil passage, and the fourth oil passage, a first end of the cooling pipe is a part of the second oil passage, and a second end of the cooling pipe is part of the fourth oil passage, extending the cooling pipe only upward in the gravitational direction and in the horizontal direction from the first end of the cooling pipe disposed on a speed increaser side of the oil cooler to the second end of the cooling pipe disposed on an oil pan side of the oil cooler, and coinciding the axis of the high-speed shaft with the axis of the low-speed shaft, the centrifugal compressor being mountable on a vehicle so that the oil pan is located on the lower side and downward in the gravitational direction with respect to the axis line of the high-speed side shaft and the axis line of the low-speed shaft.

5. The centrifugal compressor according to claim 1, wherein the first oil passage includes a seal-side supply passage and a speed increaser-side supply passage that branch off from each other.

6. The method for manufacturing the centrifugal compressor according to claim 4, wherein the first oil passage includes a seal-side supply passage and a speed increaser-side supply passage that branch off from each other.

* * * * *